US006600883B2

(12) United States Patent
Iwasaki

(10) Patent No.: US 6,600,883 B2
(45) Date of Patent: Jul. 29, 2003

(54) IMAGE FORMING APPARATUS WITH OVERHEAT PREVENTIVE DEVICE

(75) Inventor: Atsushi Iwasaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/214,103

(22) Filed: Aug. 8, 2002

(65) Prior Publication Data

US 2002/0191979 A1 Dec. 19, 2002

Related U.S. Application Data

(62) Division of application No. 09/900,045, filed on Jul. 9, 2001, now Pat. No. 6,493,520.

(30) Foreign Application Priority Data

Jul. 10, 2000 (JP) ..... 2000-208211

(51) Int. Cl.[7] ..... G03G 15/20; G03G 15/00
(52) U.S. Cl. ..... 399/33; 399/381; 399/400
(58) Field of Search ..... 399/33, 67, 69, 399/68, 381, 320, 400

(56) References Cited

U.S. PATENT DOCUMENTS

| | | | | |
|---|---|---|---|---|
| 4,792,131 | A | 12/1988 | Akiyama | |
| 4,933,724 | A | 6/1990 | Sugimoto et al. | 399/320 |
| 5,557,385 | A | 9/1996 | Tanaka et al. | 399/69 |
| 5,708,910 | A | 1/1998 | Fukano et al. | 399/381 |
| 5,771,434 | A | 6/1998 | Hokari | 399/400 |
| 5,854,959 | A | 12/1998 | Mirabella, Jr. | 399/69 |
| 5,862,436 | A | 1/1999 | Ishizawa et al. | 399/69 |
| 6,097,904 | A | 8/2000 | Tsuruno et al. | 399/33 |
| 6,151,462 | A | 11/2000 | Fukuzawa et al. | 399/67 |
| 6,185,383 | B1 | 2/2001 | Kanari et al. | 399/69 |

*Primary Examiner*—Susan S.Y. Lee
(74) *Attorney, Agent, or Firm*—Fitzpatrick, Cella, Harper & Scinto

(57) ABSTRACT

An image forming apparatus includes a heater for heating a recording material for fixing a transferred toner image to the recording material at a transfer portion. A fixing unit includes at least one overheat preventive device for preventing the heater from overheating. A recording material sensor detects a front end timing of the recording material. A part of all of the at least one overheat preventive device is placed on a plane perpendicular to a conveyance surface of the recording material and passing the recording material sensor.

2 Claims, 8 Drawing Sheets

IMAGE FORMING APPARATUS WITH OVERHEAT PREVENTIVE DEVICE

This application is a division of application Ser. No. 09/900,045, filed Jul. 9, 2001, U.S. Pat. No. 6,493,520.

BACKGROUND OF THE INVENTION

1. Field of the Invention

This invention relates to an image forming apparatus including a fixing unit used for electrophotographic photocopier, laser beam printer, and the like.

2. Description of Related Art

As a fixing unit for image forming apparatuses such as photocopiers and printers, units of thermal roller types and on-demand types have been known.

A fixing unit of the thermal roller type includes an internal thermal source such as a halogen heater or the like, and a recording material is introduced to a pressed nipping portion (fixing nipping portion) located between two rollers in a transfer unit having the two rollers, a heating roller (fixing roller) kept at a prescribed heated temperature by means of the thermal source, and an elastic pressing roller pressed to the heating roller. Unfixed images transferred on the recording material with heat from the fixing roller can be fixed on the recording material where the recording material is conveyed in the conveyance direction as sandwiched at the fixing nipping portion.

The fixing roller contacting to the surface of the recording material, between the fixing roller and the elastic pressing roller, has a cylindrical roller whose surface is made of a material of good mold releasing property, and a halogen heater is incorporated inside the roller to heat the toner transferred on the recording material through the cylindrical roller. On the other hand, the pressing roller contacting to the back surface of the recording material is constituted of a core metal and an elastic layer formed on the core metal for properly pressing the toner layer on the recording material.

The fixing unit of the on-demand type (film heating type) solves a problem on the thermal roller type such as large loss in energy, thereby enabling the unit to start quickly and save electric power. This fixing unit solves the problem on thermal loss in the thermal roller type fixing unit by rendering small the thermal capacity of the fixing unit in using a heater such as a ceramic heater and a heat resisting thin film such as polyimide as substitutions of the halogen heater and the fixing roller in the fixing unit of the thermal roller type.

In the fixing unit of the thermal roller type or the on-demand type, an overheating preventive device, or a so-called thermal protector, is generally arranged as a safety device for preventing the fixing unit from overly heated during malfunction of the fixing unit. When the unit becomes at an extraordinarily high temperature state, the thermal protector begins operating to cut off the thermal generating circuit. As a thermal protector, a thermal fuse, thermo-switch, and the like are exemplified.

The thermal protector is made in direct contact with portions of a heating body or fixing roller equivalent to a sheet passing width of the recording material or is secured to the vicinity of the portions. When the temperature of the arranged placed of the thermal protector reaches the prescribed extraordinary high temperature state, the thermal protector begins operating to cut off the thermal generating circuit.

The thermal protector's position in a longitudinal direction (a direction perpendicular to the conveyance direction) is generally in compliance with the sheet passing standard position of the image forming apparatus. To prevent the thermal protector from malfunctioning due to increased temperature of a non-sheet passing portion of the fixing unit when small size papers such as envelops and business cards pass, the thermal protector is disposed at an area within the minimum sheet passing width with respect to the sheet passing standard position. That is, the thermal protector is disposed near a center sheet passing standard line where the image forming apparatus is of the center-standard type with respect to the longitudinal direction and near an edge sheet passing standard line where the image forming apparatus is of the edge-standard type of the recording material.

However, with the arrangement structure of the conventional thermal protector, printing can be performed while the arrangement region of the thermal protector is made as the non-sheet passing area according to the positional relation of the recording material sensor such as a recording material existence detecting sensor or a recording material passing sensor.

FIG. 8 is a substantially plan view of a conventional image forming apparatus; the sheet passing standard is of the center standard with respect to the longitudinal direction. In the image forming apparatus shown as the prior art, the maximum sheet passing width during the manual feeding is 216 mm LTR size, and the guaranteed minimum passing width is 76.2 mm as the business card size of 3 inches×5 inches. As for the recording material sensors for always detecting the recording material during the series of the printing operation, provided are, at a manual feeding tray 21 located below the bottom plate 213, a recording material existence sensor Sf1, not shown, detecting as to whether the recording material exists on the manual feeding tray, at a register portion 22 for feeding the recording material P to a transfer portion 23 in synchrony with arrival of the toner image to the transfer position, a top sensor St for detecting reaching timing of the recording material's front end in the conveyance direction during conveyance of the recording material and for detecting the conveyance length of the recording material, and at a delivery portion 25, a delivery sensor Sd for detecting the delivery timing of the recording material from the fixing portion 24.

When the recording material sensors do not detect any passage of the recording material at prescribed timings during printing operation, the printing operation is controlled to be stopped, and therefore, the recording material has to be passed through all of the recording material sensors to complete the series of the printing operations.

As for the positions of the recording material sensors with respect to the longitudinal direction, the recording material existence sensor Sf1 and the top sensor St are disposed on a line at an area 33 mm right side of the sheet passing standard line A, and the delivery sensor Sd is disposed on the sheet passing standard line A.

The thermal fuse 100 as a thermal protector is in contact with the heater, but the longitudinal length of the contacting portion is 10 mm, whose center of gravity is located at a point 20 mm left side of the sheet passing standard line A.

The minimum sheet passing width of this image forming apparatus is 76.2 mm; with respect to the center standard, ranges 38.1 mm right and left of the sheet passing standard line A constitute the minimum sheet passing width; the recording material sensor and the thermal protector are disposed within the minimum sheet passing width.

With the above structured image forming apparatus, the series of printing operations can be performed at a state that the arranged area of the thermal protector is made of the non-sheet passing region.

That is, as shown in FIG. 8, the recording material width regulation plate 212 mounted on a manual feeding tray 210 is made widest, and the series of printing operations can be performed by passing the recording materials through all the recording material sensors while the arranged are of the thermal protector 100 is made as the non sheet passing area where the recording material such as an envelop having the width of 110 mm is passed as shifted toward the right edge.

Thus, where the sheet passage is possible in a manner of feeding different from the product specification, printing can be done while the arranged area of the thermal protector is made as the non sheet passing area depending on the positional relation of the recording material sensors, so that the temperature is readily increased due to the increase of the temperature of the non sheet passing area, and so that margins for the operation standard temperature of the thermal protector becomes small.

Though not guaranteed, where the recording material width regulation plate 212 is narrowed at minimum to pass the materials, for example, such as stripes having a width of 40 mm at a state that placed toward the right edge, or namely, where the recording materials having a width less than the guaranteed minimum sheet passing width is passed, substantially the same problem may be raised. This is also applicable to an image forming apparatus of the edge sheet passing standard type.

SUMMARY OF THE INVENTION

It is an object of the invention to provide an image forming apparatus solving the above problems and being able to include, within the sheet passing area, the arrangement area of the thermal protector whenever a series of printing operations is completed.

According to an aspect of the invented image forming apparatus, because a part or all of overheat preventive devices for preventing the heater from overly heated (thermal protector or protectors) are placed at an area between any two planes which are perpendicular to a conveyance surface of the recording material and are extending parallel in the conveyance direction, through which plural recording material sensors pass, the position of the thermal protector is not subject to printing as a non sheet passing area, thereby improving the reliability of the thermal protector. The margins in respect to the operation standard temperature of the thermal protector are prevented from lowering due to increased temperature of the non sheet passing area caused by printing in a state that the arrangement area of the thermal protector is used as the non sheet passing area.

In another aspect, an image forming apparatus including a fixing device having, for fixing a transferred toner image onto a recording material, a heater for heating the recording material, and an overheating prevention device for the heater, and a recording material sensor such as a recording material existence sensor or a recording material passage sensor on a conveyance route of the recording material, is characterized in that an overheat preventive device or overheat preventive devices for preventing the heater from overly heated is placed astride one plane of planes parallel to the conveyance direction but perpendicular to the conveyance surface of the recording material in passing through any one of the recording material sensors.

According to this image forming apparatus, since the overheat preventive device or overheat preventive devices for preventing the heater from overly heated are placed astride one plane of planes parallel to the conveyance direction but perpendicular to the conveyance surface of the recording material in passing through any one of the recording material sensors, the position of the thermal protector is not subject to printing as a non sheet passing area, thereby improving the reliability of the thermal protector. The margins in respect to the operation standard temperature of the thermal protector are prevented from lowering due to increased temperature of the non sheet passing area caused by printing in a state that the arrangement area of the thermal protector is used as the non sheet passing area.

In the above image forming apparatuses, the fixing device can be of a so-called on-demand type fixing apparatus including a heater for heating a recording material through a thin film and a pressing body for pressing the body to the heater via the thin film.

According to this structure, the image forming apparatus can be provided with not only that the margins in respect to the operation standard temperature of the thermal protector are prevented from lowering due to increased temperature of the non sheet passing area caused by printing in a state that the arrangement area of the thermal protector is used as the non sheet passing area, but also that the thermal capacity of the fixing devise is small.

DESCRIPTION OF PREFERRED EMBODIMENTS

This invention is described in detail according to the following embodiments.

Image Forming Apparatus

Figure 1:
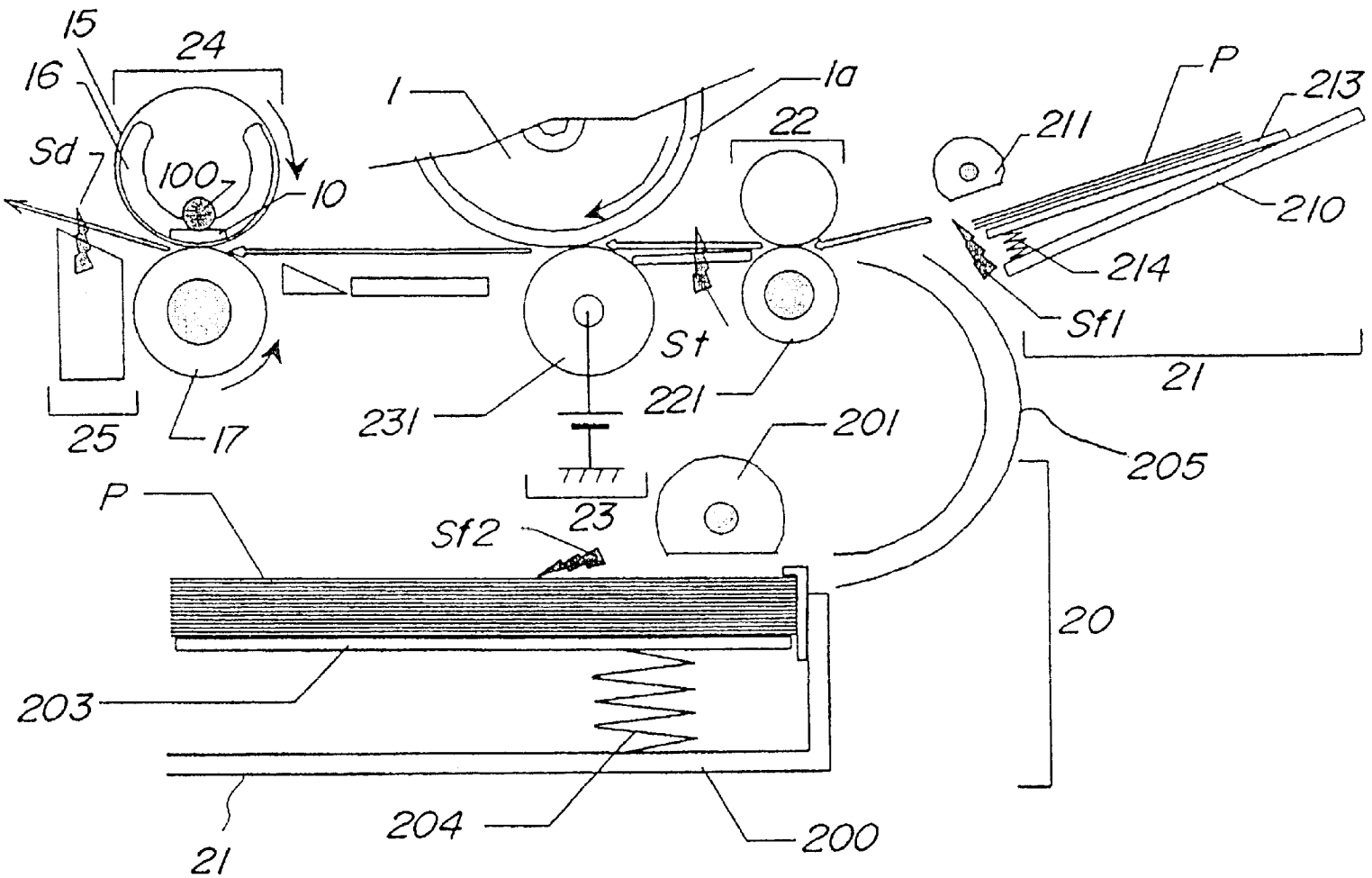
FIG. 1 is a schematic cross section showing an essential portion of an image forming apparatus.

FIG. 1 is a schematic cross section showing an essential portion of an image forming apparatus to which this invention applies. The image forming apparatus has a photosensitive drum 1 having a photoconductive interlayer insulation film 1*a* on a surface of the drum and rotating in a direction of an arrow. It is to be noted that illustrations of latent image forming means, developing means, and cleaning means for removing remaining toners after transfer, which are formed around the photosensitive drum, are omitted. A transfer portion 23 as described below in detail is provided in facing to the photosensitive drum 1, and in the image forming apparatus of the invention it is structured that the toner image formed on the photosensitive drum 1 is transferred to the transfer portion 23 with a minus charged state.

The recording materials P conveyed in synchrony with the formation of the toner image on the photosensitive drum 1 are stacked on a manual feeding mechanism 21 including a manual feeding tray 210 or on an automatic feeding mechanism 20 including cassette feeding tray 200 and the like, and the recording material existence sensors Sf1, Sf2 are formed respectively at the feeding trays 210, 200. When the feeding trays 210, 200 have no recording material P, the image forming apparatus informs the user of a message "no recording material" at a time when receiving the print signal.

With the manual feeding mechanism 21, the manual feeding tray 210 has a spring 214, a bottom plate 213 attached to the manual feeding tray 210 via the spring 214, and a manual feeding roller 211 whose portion of the circumference is cut out. The mechanism 21 is structured that the recording materials P on the bottom plate 213 pushed upward by the spring 214 are fed sheet by sheet out of the manual feeding tray 210 at every rotation of the manual feeding roller 211. On the other hand, with the automatic feeding mechanism 20, the cassette feeding tray 200 has a spring 204, a bottom plate 203 attached to the manual feeding tray 200 via the spring 204, and a cassette feeding roller 201 whose portion of the circumference is cut out. The mechanism 20 is structured that the recording materials P on the bottom plate 203 pushed upward by the spring 204 are fed sheet by sheet out of the feeding tray 200 at every rotation of the cassette feeding roller 201. The automatic feeding mechanism 20 has a guide plate 205 for guiding the recording materials P to a register portion as described below.

The recording material P fed from the cassette feeding tray 200 is fed to the register portion 22, by way of the guide plate 205; the recording material P fed from the manual feeding tray 21 is fed directly to the register portion 22. The register portion 22 is for feeding the recording material P to the transfer portion 23 in synchrony with the transfer position of the toner image; the register roller 221 is driven in synchrony with the transfer arrival of the toner image; the recording material P passed by the register portion 22 passes through the top sensor St and reaches the transfer portion 23. The top sensor St detects the front end reaching timing and the conveyance length of the recording material P.

At the transfer portion 23, the transfer roller 231 flows transfer current of the reverse polarity with respect to the toner image on a printed surface of the recording material P, and the toner image on the photosensitive drum 1 is transferred to the transfer paper P. After transfer, the image is conveyed to a fixing portion 24 from the photosensitive drum 1, and after the transferred image is fixed to the recording material P at the fixing portion 24, the recording material P is conveyed out of the apparatus upon passing by a delivery sensor Sd. Where the front end reaching timing to the delivery sensor and the delivery sensor passing time estimated from the front end reaching timing and the conveyance length of the recording material P detected by the top sensor St are out of the prescribed time range, the image forming apparatus informs a message "recording material jam" to the user and stops the printing operation and control.

In this embodiment, a detecting device made of a sensor lever and a photo sensor (each not shown) is used for the recording material existence sensors Sf1, Sf2, the top sensor St, and the delivery sensor Sd.

The fixing portion 24 is an on-demand type apparatus of a press roller drive method and includes a ceramic made heater 10. This heater 10 is held with a film holding member 16 and made in pressurized contact with a pressing roller 17 via a cylindrical shaped heat-resisting film 15, and a fixing nipping portion is formed between the pressing roller 17 and the heat-resisting film 15.

Heating operation by current to the heater 10 can be controlled by a temperature controlling means (not shown). The temperature controlling means has a temperature controlling device, not shown, attached to a back surface of the heater 10, and a CPU, not shown, controlling a triac, not shown, based on the temperature detected by the temperature controlling device and controlling the current flowing through the heater 10.

A temperature fuse 100 serving as an overheat preventive device for preventing the heater from overly heated (thermal protector) is in contact with a prescribed position on the back surface (opposite side of the heating elements) of the heater 10 at a proper pressure. When the portion reaches a predetermined extraordinary temperature, the temperature fuse 100 cuts off the current to the heater 10.

First Embodiment

Figure 2:
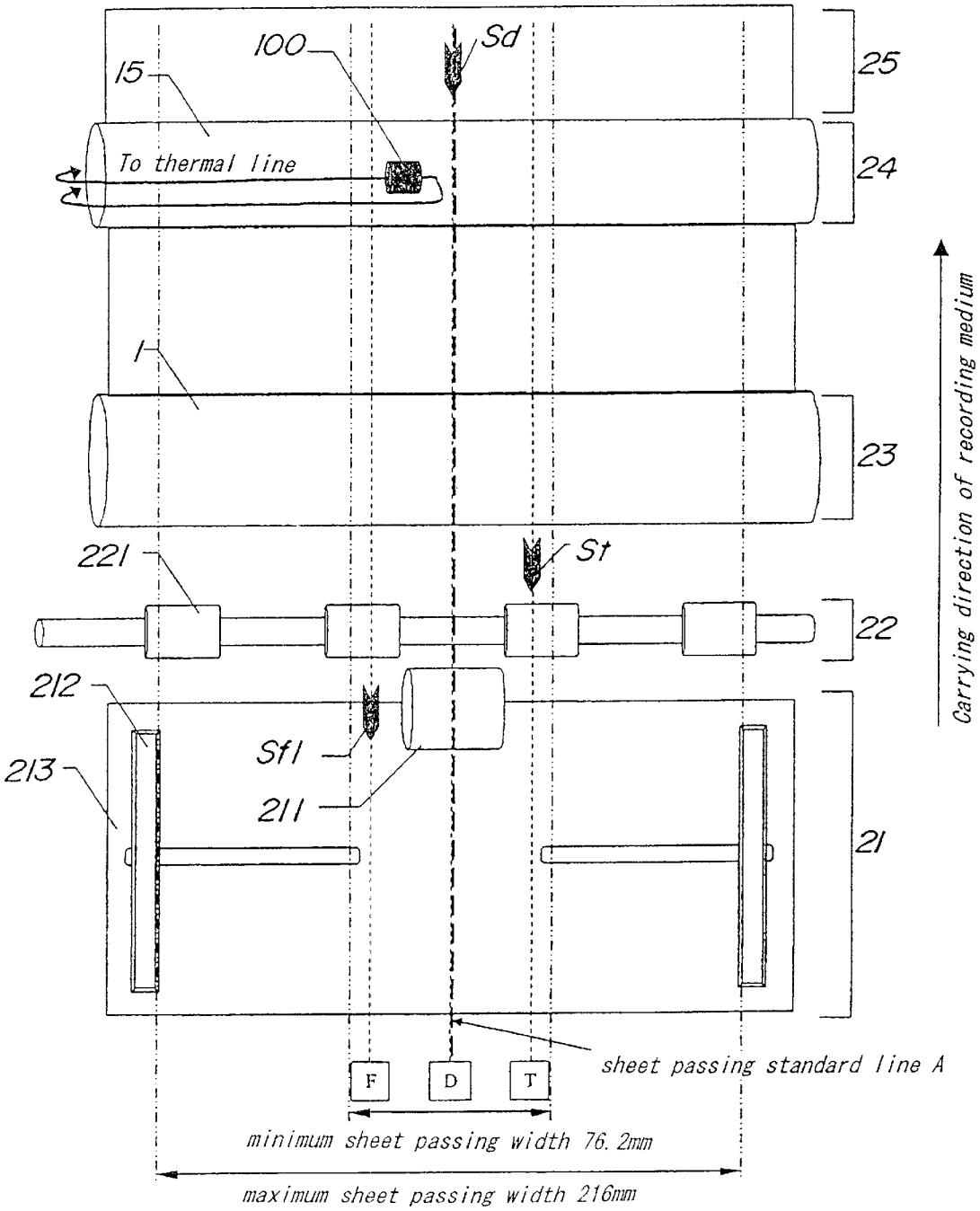
FIG. 2 is a schematic plan view showing the essential portion of the image forming apparatus of the first embodiment.

An embodiment of the invention applying to the image forming apparatus shown in FIG. 1 is described. FIG. 2 is a schematic plan view showing an essential portion of the image forming apparatus of the above embodiment of the invention. Here, the sheet passing standard is a center standard with respect to the longitudinal direction. In this image forming apparatus of this embodiment, the LTR size maximum sheet passing width for the manual feeding is 216 mm, and the guaranteed minimum sheet passing width is 76.2 mm for business card size of 3 inches×5 inches.

As for the positions of the recording material sensors described above with respect to the longitudinal direction, when seen with respect to the sheet passing standard line A, the recording material existence sensor Sf1 is located at a position 33 mm left side of the sheet passing standard line A; the top sensor St is located at a position 33 mm right side of the sheet passing standard line A; the delivery sensor Sd is located at a position on the sheet passing standard line A.

The longitudinal length of the contact portion between the thermal fuse 100 and the heater is 10 mm, and the center of the gravity is located at a position 20 mm left side of the sheet passing standard line A.

The minimum sheet passing width of the image forming apparatus is 76.2 mm, and when seen with respect to the sheet passing standard line A, the minimum sheet passing width range is up to 38.1 mm on right and left sides, so that the respective sensors and the temperature fuse 100 are within the range of the minimum sheet passing width.

In this embodiment, entire portion of the temperature fuse 200 is structured as contained between a straight line F extending through the recording material existence sensor Sf1 and being parallel to the sheet passing standard line A and a straight line T extending through the top sensor St and being parallel to the sheet passing standard line A. At the same time, in this embodiment, the temperature fuse 100 is structured as placed between the straight line F extending through the recording material existence sensor Sf1 and being parallel to the sheet passing standard line A and a straight line D extending through the delivery sensor Sd and being parallel to the sheet passing standard line A. With this structure, the temperature fuse 100 is surely located within the sheet passing area during a series of printing operations in which the recording material P passes all of the respective recording material sensors. Even if the region at which the temperature fuse 100 is arranged becomes a non sheet passing area because of selection of a sheet passing method not in compliance with the sheet passing standard, the recording material P cannot pass some recording material sensor in this situation, and therefore, the image forming apparatus stops the printing operation and control and cannot complete the series of the printing operation processes. Therefore, this apparatus can prevent the margins from decreasing with respect to the standard operation temperature of the temperature fuse 100 because the non sheet passing area is free from increase of the temperature.

Figure 3:
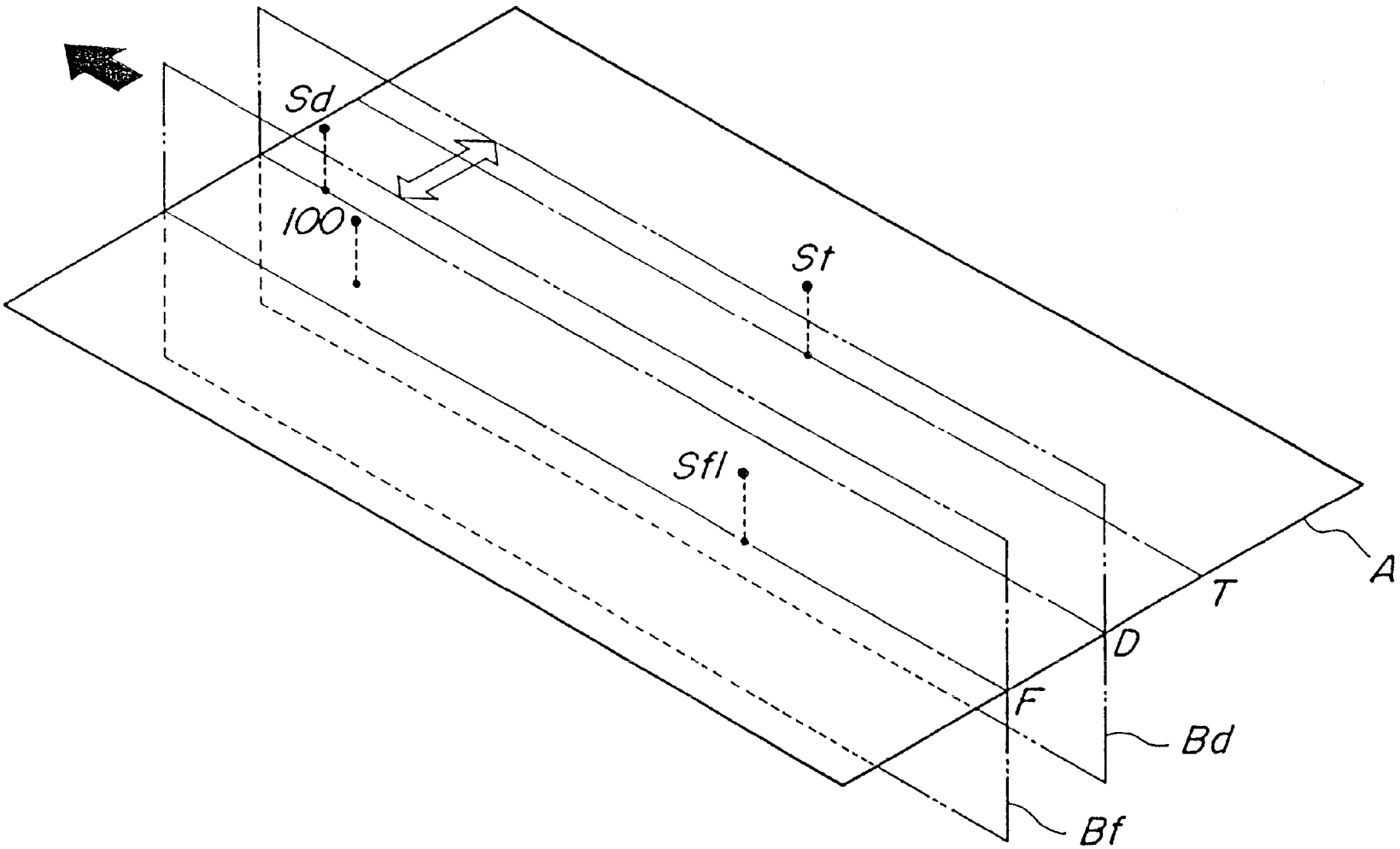
FIG. 3 is a structural illustration showing the first embodiment.

That is, though FIG. 3 shows a structural diagram, in this embodiment, the thermal protector or temperature fuse 100 is disposed at an area between a plane Bf perpendicular to the conveyance surface A of the recording material P but parallel to the conveyance direction of the recording material P in extending through the recording material existence sensor Sf and a plane Bd perpendicular to the conveyance surface A of the recording material P but parallel to the conveyance direction of the recording material P in substantially the same way in extending through the delivery sensor Sd.

As described in this embodiment, with respect to the plural recording material sensors, such as the recording material sensor in the image forming apparatus or the recording material passing sensor, through which the recording material P inevitably passes during the processes of the series of the printing operations, the thermal protector is located in the area sandwiched between any two planes among planes parallel to the conveyance direction in perpendicular to the conveyance surface in passing on these recording material sensors, so that no printing is made where the area at which the thermal protector is placed is used as the non sheet passing area, and as a result, the thermal protector can have an improved reliability. It is to be noted that the thermal protector is desirably placed at an area between the above two planes, but substantially the same advantages to this embodiment can be obtained where a part of the thermal protector can be located at an area between the above two planes.

Second Embodiment

Figure 4:
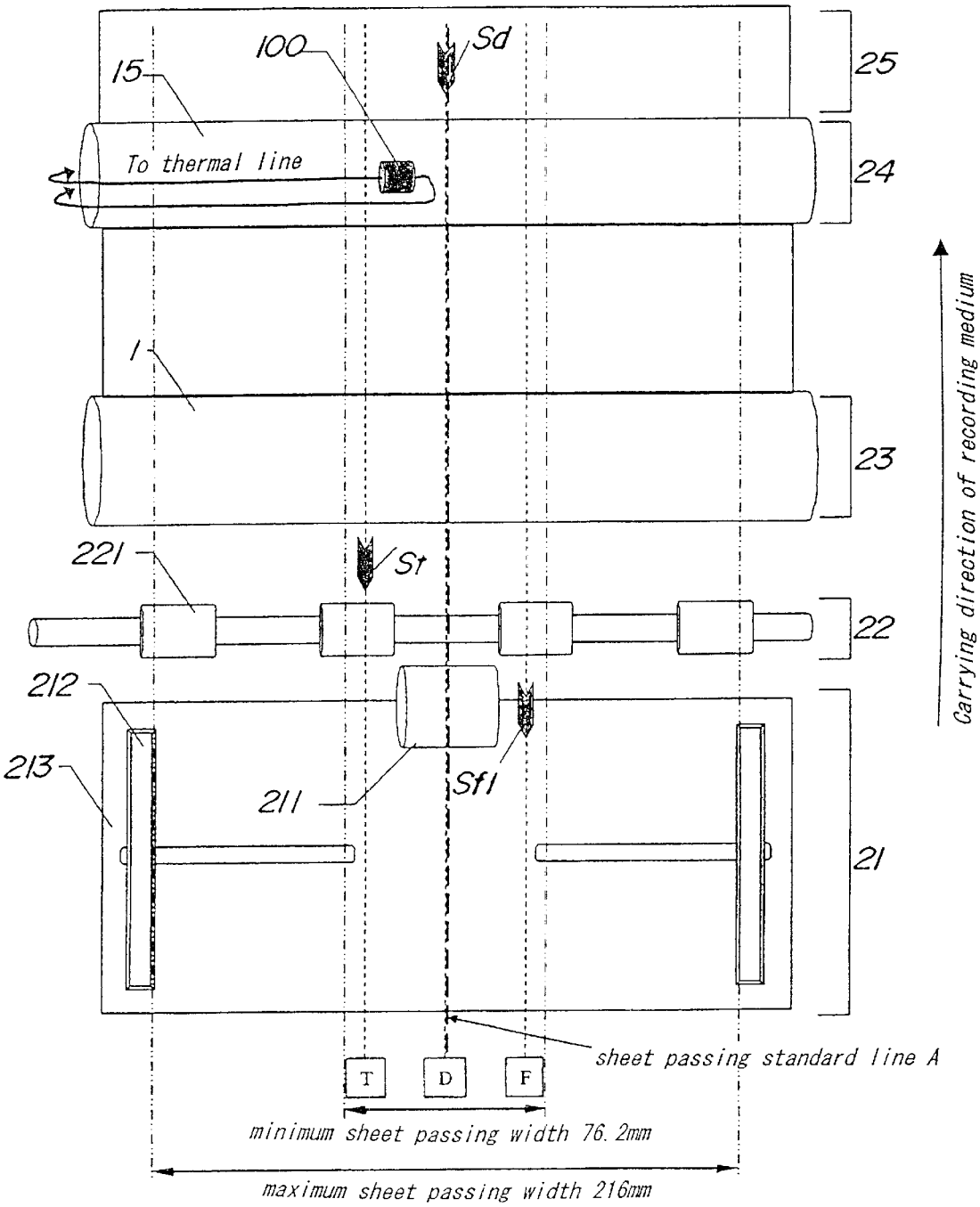
FIG. 4 is a schematic plan view showing the essential portion of the image forming apparatus of the second embodiment.

FIG. 4 is a schematic plan view showing the essential portion of the image forming apparatus of the second embodiment of the invention, applying to the image forming apparatus shown in FIG. 1.

The image forming apparatus of the embodiment has at least the following three sensors serving as the recording material sensors. That is, those are a recording material existence sensor Sf1 as a first sensor for detecting where the recording material exists on the manual feeding tray 210, a top sensor St serving as the second sensor for detecting the front end reaching timing and the conveyance length of the recording material P during the conveyance, and a delivery sensor Sd serving as third sensor for detecting the recording material delivery timing delivered out of the fixing unit 24. Those sensors are disposed from the upstream side to the downstream side in the conveyance die of the recording material in the order of the first sensor, the second sensor, and the third sensor.

The points of the image forming apparatus according to the second embodiment, different from the first embodiment, are in that the top sensor St is located on a left side of the sheet passing standard line A, and that the temperature fuse 100 is located between a straight line T passing through the top sensor St and being parallel to the sheet passing standard line A and a straight line D passing through the delivery sensor Sd and being parallel to the sheet passing standard line A.

Although in the first embodiment, the temperature fuse 100 is disposed between the recording material existence sensor Sf1 and other sensors Sd, St, the image forming apparatus shown in FIG. 2 for example can complete the series of the printing operation processes as the temperature fuse 100 is at the non sheet passing area because envelopes could be passed through where printing is made as the envelopes having a width of 110 mm are oriented on a right side of the tray on the LTR paper stacked on the manual feeding tray 210 to render not the envelope itself pass the recording material existence sensor Sf1 but the LTR paper placed below the envelope pass the recording material existence sensor Sf1 and to render the image forming apparatus indicate a message "recording material exists."

To the contrary, according to the image forming apparatus in the second embodiment shown in FIG. 4, since the temperature fuse 100 is located between a straight line T passing through the top sensor St and being parallel to the sheet passing standard line A and a straight line D passing through the delivery sensor Sd and being parallel to the sheet passing standard line A, the recording material has to pass the top sensor St and the delivery sensor Sd to complete the series of the printing operation processes notwithstanding of a stacking manner of the recording materials P on the manual feeding tray 210, and at that time, the temperature fuse 100 is inevitably contained in the sheet passing area.

Figure 5:
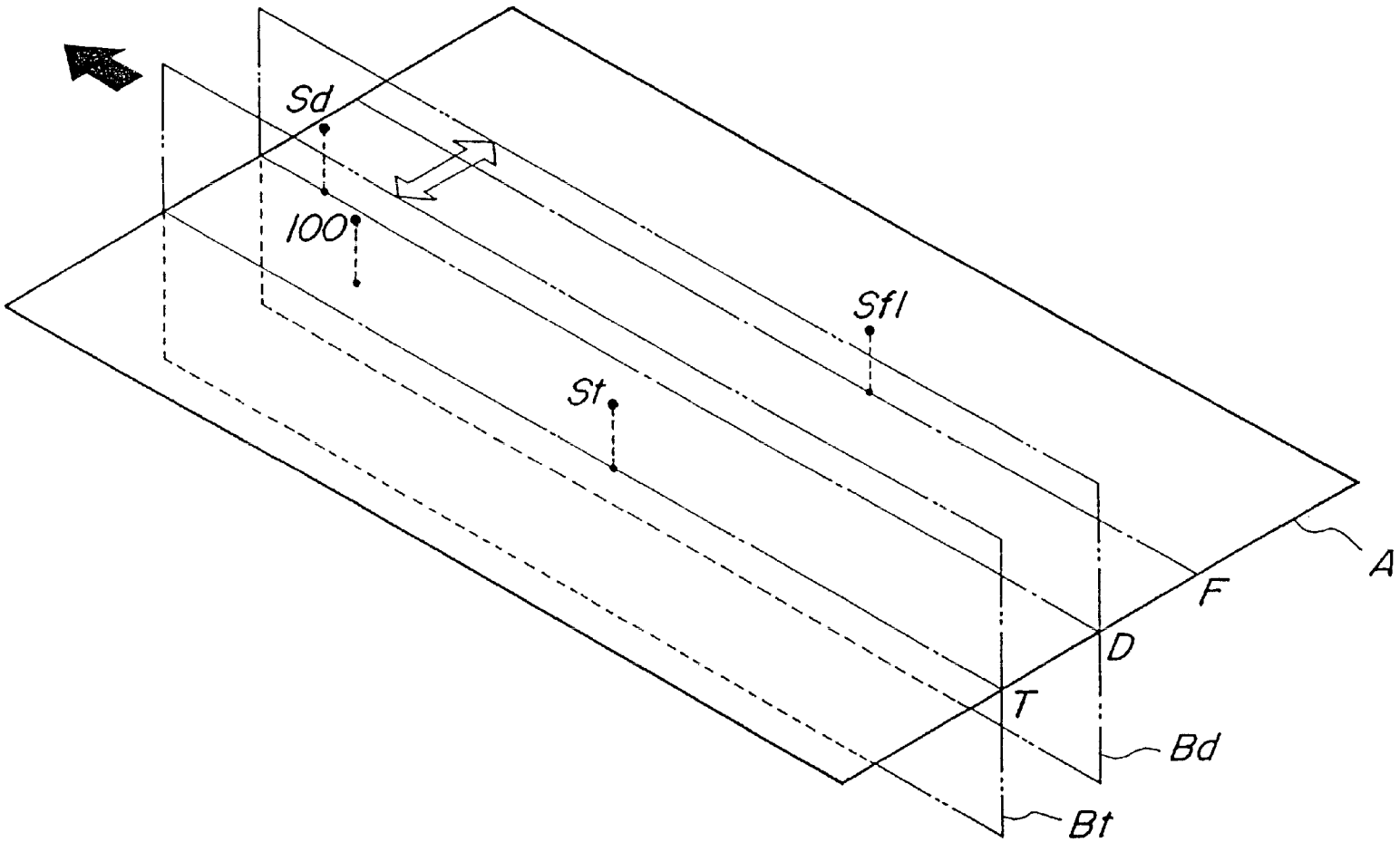
FIG. 5 is a structural illustration showing the second embodiment.

That is, though FIG. 5 shows a structural diagram, in this embodiment, the thermal protector or temperature fuse 100 is disposed at an area between a plane Bt perpendicular to the conveyance surface A of the recording material P but parallel to the conveyance direction of the recording material P in extending through the top sensor St and a plane Bd perpendicular to the conveyance surface A of the recording material P but parallel to the conveyance direction of the recording material P in substantially the same way in extending through the delivery sensor Sd.

With the structure as in this embodiment, the image forming apparatus can be provided to complete the series of the printing operations as including the thermal protector in the sheet passing area notwithstanding of the stacking manner of the recording materials P on the manual feeding tray.

Third Embodiment

Figure 6:
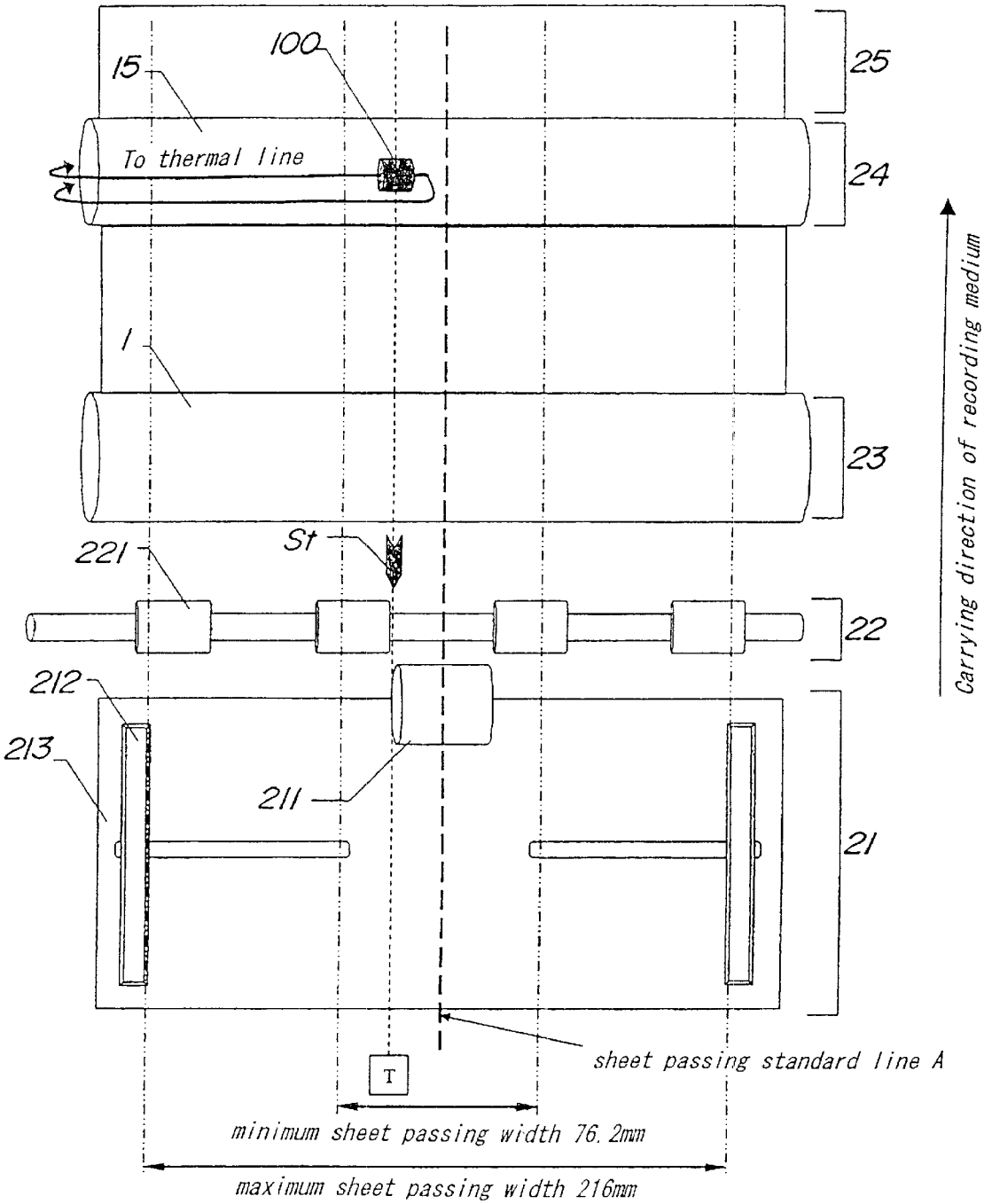
FIG. 6 is a schematic plan view showing the essential portion of the image forming apparatus of the third embodiment.

FIG. 6 is a schematic plan view showing the essential portion of the image forming apparatus of the third embodiment of the invention, applying to the image forming apparatus shown in FIG. 1. The points of the image forming apparatus according to the third embodiment, different from the first embodiment, are in that any sensor through which the recording material P has to pass during the series of the printing operations is only the top sensor St and that the temperature fuse 100 is located astride a straight line parallel to the sheet passing standard line in passing through the top sensor St.

Figure 7:
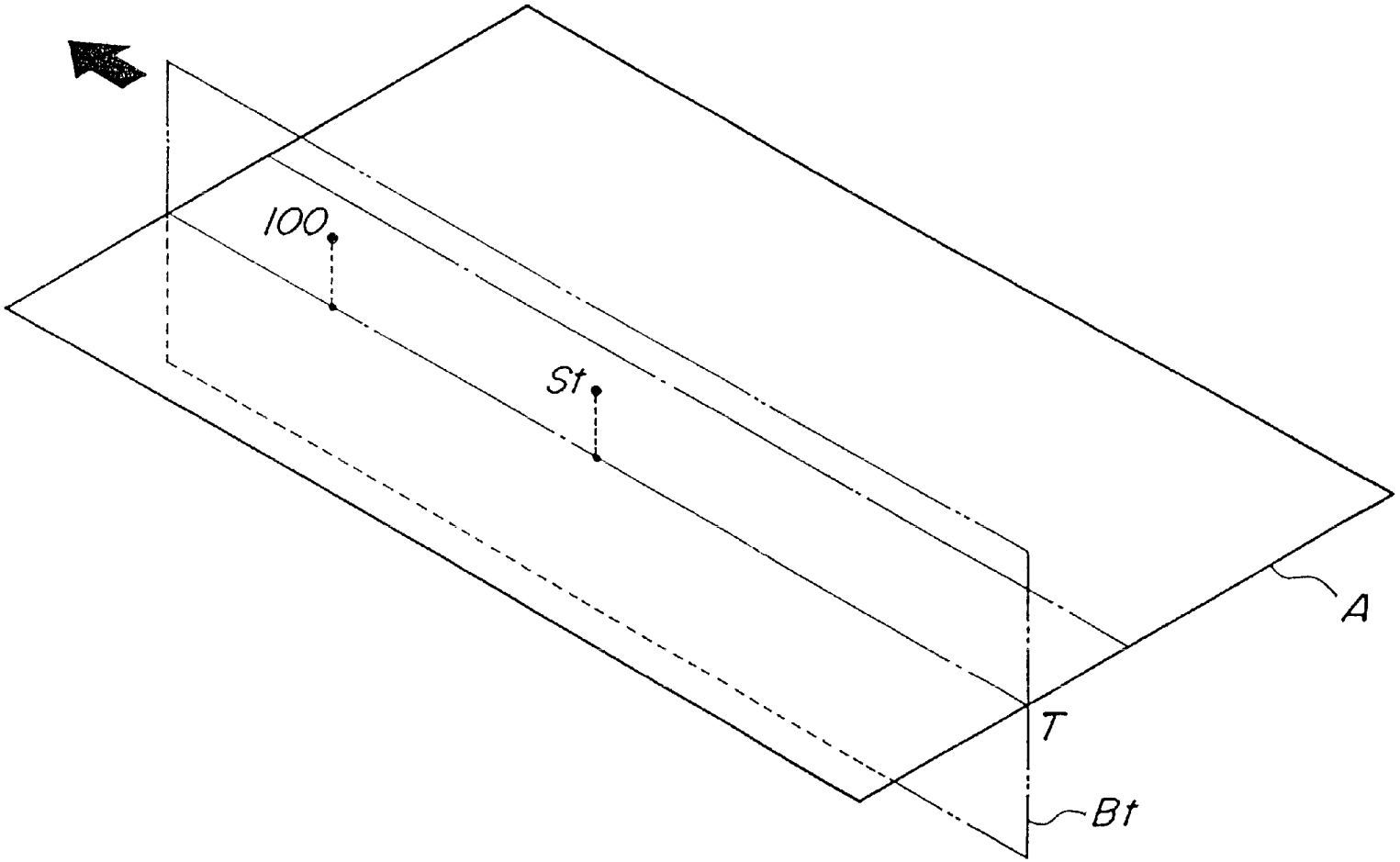
FIG. 7 is a structural illustration showing the third embodiment.
Figure 8:
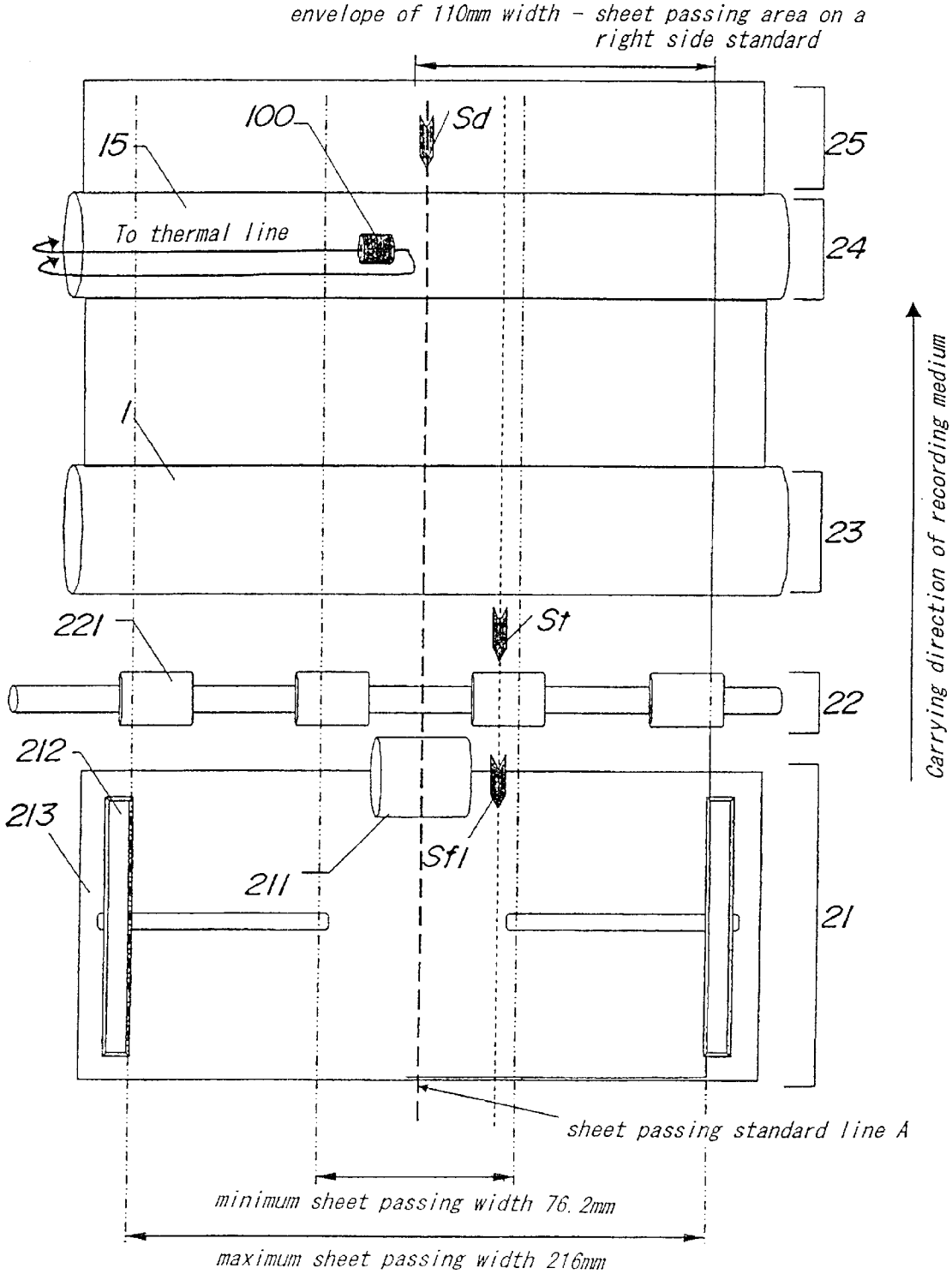
FIG.8 (Prior Art)
FIG. 8 is a schematic plan view showing the essential portion of a conventional image forming apparatus.

That is, though FIG. 7 shows a structural diagram, in this embodiment, the thermal protector or temperature fuse 100 is disposed on a plane Bt perpendicular to the conveyance surface A of the recording material P but parallel to the conveyance direction of the recording material P in extending through the top sensor St.

With this third embodiment, the apparatus cannot be formed with a structure that the temperature fuse 100 is located between the two sensors as shown in the first and second embodiments because the apparatus uses a single recording material sensor through which the recording material passes during the series of printing operations. However, as in this embodiment, since the thermal protector is disposed astride the straight line parallel to the sheet passing standard line in passing through the single sensor, at least a portion of the thermal protector is located within the sheet passing area of the recording material P, so that the same advantages as of the first and second embodiments are obtainable. The thermal protector is prevented from lowering its reliability with the structure of the third embodiment in the image forming apparatus even where the recording material sensors are reduced due to reduction of costs.

Although in the first to third embodiments as described above are relating to an image forming apparatus including a fixing unit of an on-demand type, this invention is applicable to an image forming apparatus containing a fixing unit of a thermal roller type.

What is claimed is:

1. An image forming apparatus comprising:

a heater for heating a recording material for fixing a transferred toner image to the recording material at a transfer portion;

a fixing unit having at least one overheat preventive device for preventing said heater from overheating; and a recording material sensor for detecting a front end timing of the recording material, wherein a part or all of the at least one overheat preventive device is placed on a plane perpendicular to a conveyance surface of the recording material and passing said recording material sensor.

2. The image forming apparatus according to claim 1, wherein said heater heats the recording material via a thin film, and said fixing unit includes a pressing body for pressing said heater via the thin film.

* * * * *